US005415591A

United States Patent [19]

Beene

[11] Patent Number: 5,415,591

[45] Date of Patent: May 16, 1995

[54] ARCUATE GUTTER DISPLACEMENT FOR BUMPER BOWLING

[76] Inventor: Bobby R. Beene, 9919 Ila Dr., Dallas, Tex. 75220

[21] Appl. No.: 308,976

[22] Filed: Sep. 20, 1994

[51] Int. Cl.[6] ..... A63D 5/00

[52] U.S. Cl. ..... 473/113; 473/55

[58] Field of Search ..... 473/55, 113, 106

[56] References Cited

U.S. PATENT DOCUMENTS

| | | | |
|---|---|---|---|
| 3,401,933 | 9/1968 | Conklin et al. | 273/37 |
| 4,330,122 | 5/1982 | Sheinberg et al. | 273/51 |
| 4,420,155 | 12/1983 | Sheinberg et al. | 273/51 |
| 4,900,024 | 2/1990 | Chandler et al. | 273/37 |
| 5,181,716 | 1/1993 | Stephens | 273/51 |
| 5,207,422 | 5/1993 | Beene | 273/37 |

*Primary Examiner*—Vincent Millin
*Assistant Examiner*—William M. Pierce
*Attorney, Agent, or Firm*—W. Thomas Timmons; Timmons & Kelly

[57] ABSTRACT

An improved bowling alley bumper system for selectively guarding against the throwing of gutter balls. Comprising the system is a gutter formed of transversely divided elongated sections of which at least one is pivotally displaceable by underside actuator apparatus from a first position cooperating with the remaining section to form a conventional unguarded gutter to a second position extending above the adjacent lane bed to afford a bumper bowling effect.

10 Claims, 4 Drawing Sheets

ARCUATE GUTTER DISPLACEMENT FOR BUMPER BOWLING

FIELD OF THE INVENTION

The field of art to which the invention relates comprises bowling alley bumper systems and more particularly such systems in which an elongated portion of the gutter structure can per se be raised selectively to guard against a misdirected ball entering the gutter.

BACKGROUND OF THE INVENTION

In recent years there has been an increased trend toward encouraging bowling among the handicap, the young and otherwise unskilled bowlers by the use of bumper systems that preclude the throwing of "gutter balls". In such systems, an elongated longitudinal guard is either permanently, removably or retractably placed in a blocking relation along the length of the gutter for a selected bowling lane. The presence of the bumper prevents thrown but misdirected balls from entering the gutter anywhere along the length of the bowling lane by deflecting a bumped ball back onto the lane toward the pins. The effect thereof is to prevent the thrower of the ball, particularly an unskilled bowler or the young from becoming discouraged toward the game. Instead, it provides a psychological up-lift in that by means of such bumpers every thrown ball results in at least some downed pins and a realization of scoring. At the same time, the cost of such systems is, as always, a paramount concern to the proprietor of the bowling alley.

BACKGROUND OF THE PRIOR ART

Various bumper systems at bowling alleys have heretofore been proposed as disclosed for example in U.S. Pat. Nos. 3,401,933; 4,330,122; 4,420,155; 4,900,024; 5,181,716 and 5,207,422.

The '024 and '422 patents, of which I am co-inventor and inventor respectively, deploy retractably mounted bumpers alongside the otherwise conventional gutters adjacent the lane beds of the bowling alley. When the bumpers are retracted, they are positioned along the outer edge of the gutters so as to provide conventional gutter exposure into which a badly thrown ball can readily enter. When bumping is desired, the bumpers are outwardly extended parallel and in overlying relation to the gutters so as to ward off and deter any bowling ball that would otherwise have entered the gutter.

OBJECTS OF THE INVENTION

It is an object of the invention to provide novel improvements for a retractable bowling alley bumper system.

It is a further object of the invention to provide a functionally similar bumper system as in the previous object while effecting significant cost savings in the fabrication and installation of such systems.

It is a still further object of the invention to effect the previous objects with a structural arrangement in which the gutter per se is at least partially utilized for selective displacement between a first position permitting conventional bowling to be conducted and a second position that is functional for carom bowling that prevents gutter entry of a misdirected ball.

SUMMARY OF THE INVENTION

This invention relates to a novel bowling alley bumper system selectively usable for either conventional or bumper bowling. More specifically, the invention relates to a novel construction approach in which longitudinally arcuate portions of the gutter, normally arranged in a cooperative semi-circular functional arrangement for conventional gutter service, can be partially raised above the adjacent lane bed for bumper service.

The foregoing is achieved in accordance herewith by means of a longitudinal concave-dished gutter construction transversely divided into two interfitting arcuate sections. At least one or both of the sections is pivotally mounted to the adjacent lane bed and can be selectively raised arcuately by means of an underside actuator such as an electric bell crank or pneumatic piston. Arcuate displacement is independent of the remaining section that is generally stationary. The operating mechanism to effect section displacement is relatively simple yet readily able to withstand the imposed force of a bumped ball.

The above noted features and advantages of the invention as well as other superior aspects hereof will be further appreciated by those skilled in the art upon reading the detailed description that follows in conjunction with the drawings.

DESCRIPTION OF THE PREFERRED EMBODIMENT

Figure 1:
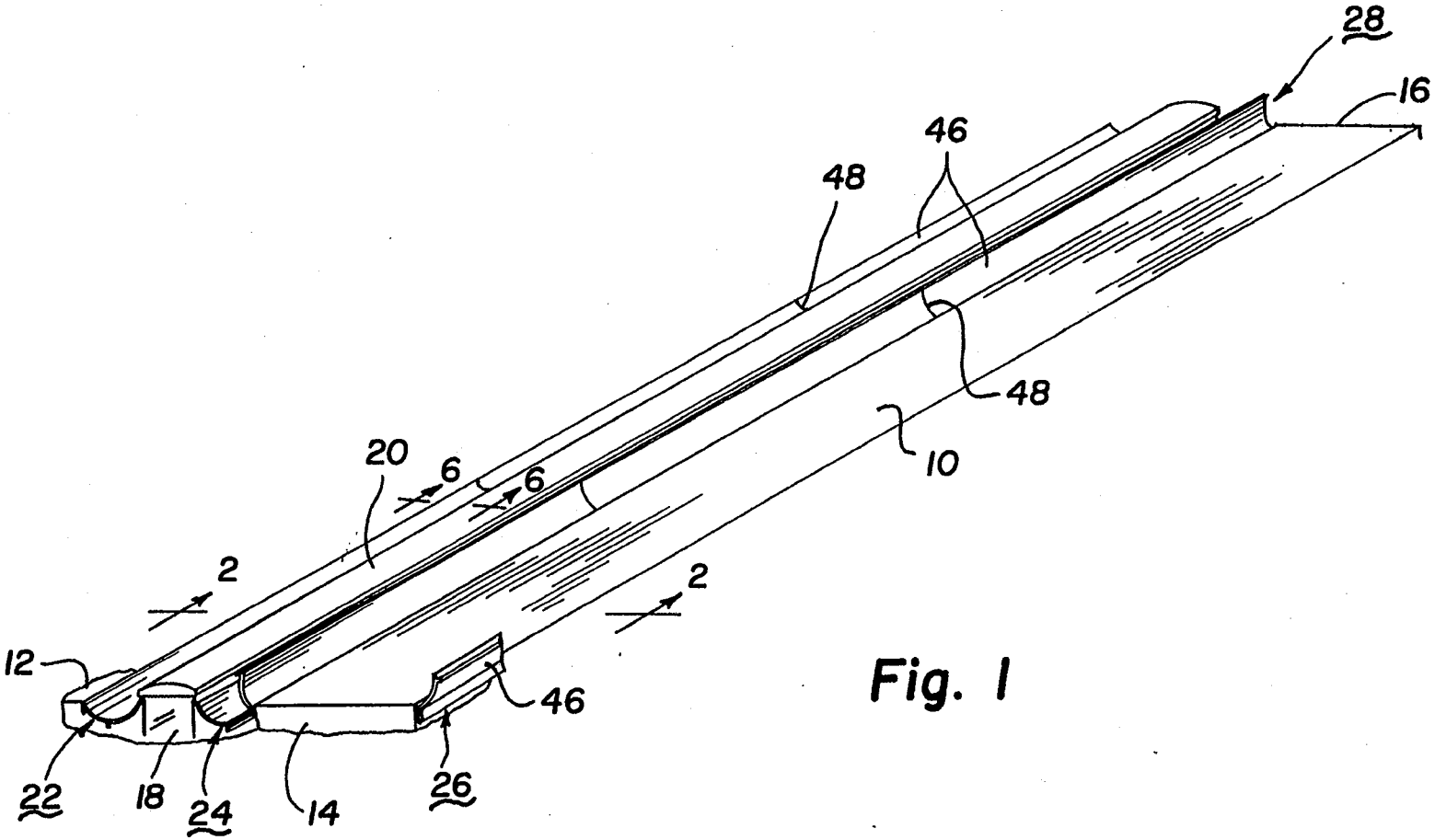
FIG. 1 is a fragmentary isometric view of juxtaposed bowling lanes providing the selectively guarded gutter structure of the invention.

In the description which follows, like parts are marked throughout the specification and drawings with the same reference numerals respectively. The drawing figures are not necessarily to scale and in certain views, parts may have been exaggerated for purposes of clarity.

Figure 2:
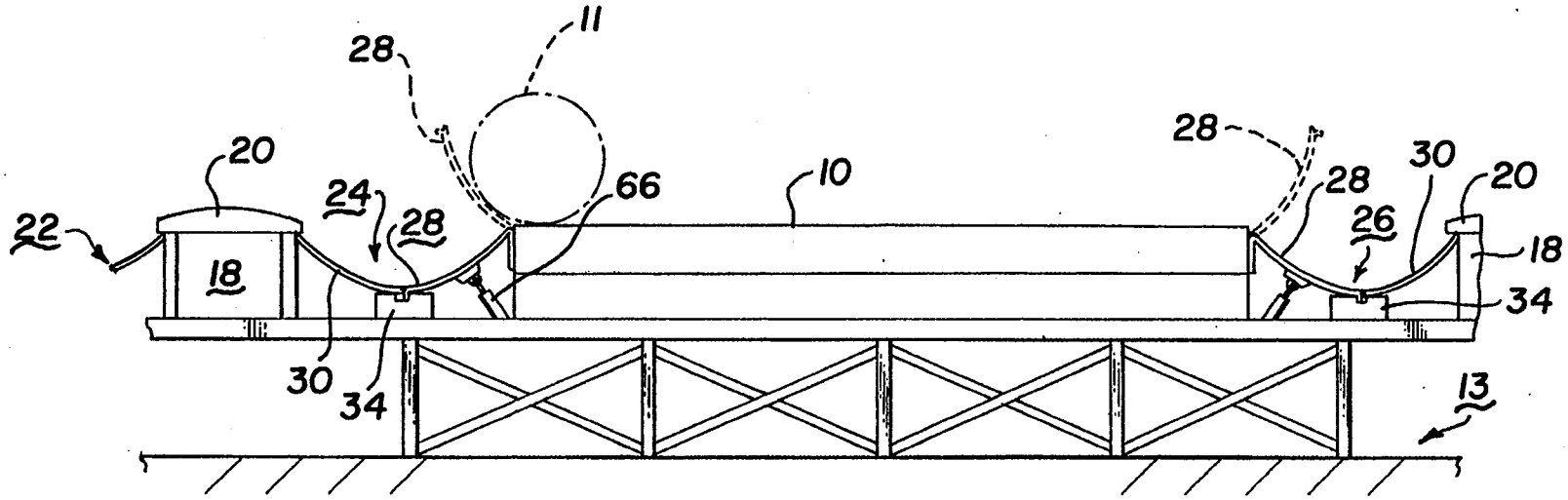
FIG. 2 is an enlarged sectional view as seen substantially along the lines 2—2 of FIG. 1.

Referring now to the drawings, there is illustrated in FIG. 1 a typical pair of parallel juxtaposed bowling alley lane beds 10 and 12 supported on a sub-structure 13 of a type illustrated in FIG. 2. The lane beds extend from an entry 14 where a bowling ball 11 is normally delivered onto the lane to a distal end 16 where bowling pins are normally set for play. Intervening between the lanes is a ball return 18 that may include a longitudinal cap 20. Along opposite sides of the lane beds are longitudinal gutters 22, 24 and 26 one or more of which are constructed in accordance with the invention hereof to be described.

The gutter construction hereof, as exemplified by any of gutters 22, 24, or 26 is comprised of transversely divided elongated longitudinal sections 28 and 30 that centrally overlie a longitudinal support block 34. Each of the separate sections include a concave formation such that the contiguous distal edges of each effect a mutual interfit 32. Forming the interfit is a longitudianal offset 36 (FIG. 3) at the distal edge of section 30 adapted to receive a longitudinal tongue 38 on the distal inner edge of section 28. In this relation, the sections cooperate to form a conventional gutter into which mis-directed balls are received and disposed of beyond distal end 16 of the lane bed. Both sections 28 and 30 are constructed of a rigid impact resistant material that can for example, comprise high impact plastic such as Lexan®. For purposes of the described embodiment, section 28 is displaceable while section 30 is permanently secured along its upper edge at the underside of cap 20 and attached securely to block 34.

Comprising section 28 is a plurality of longitudinal tandem segments 46 each about 10–20 feet in length defining a transverse seam 48 where joined together via a doubler 50. Each of the segments include a vertical longitudinal flange 40 secured to the sidewall of lane bed 12 by means of screws 42 and which is integrally joined to the respective segment 46 via a living hinge 44.

Figure 6:
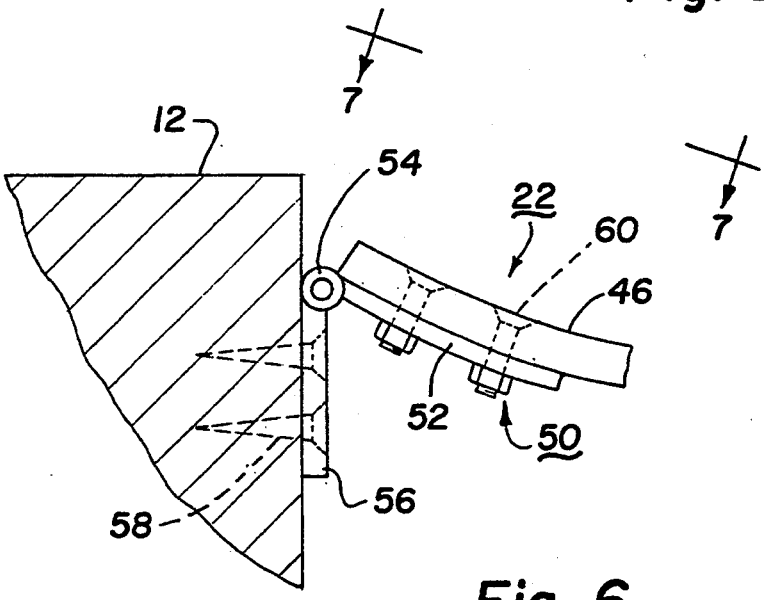
FIG. 6 is a fragmentary sectional view as seen substantially along the lines 6—6 of FIG. 1.
Figure 7:
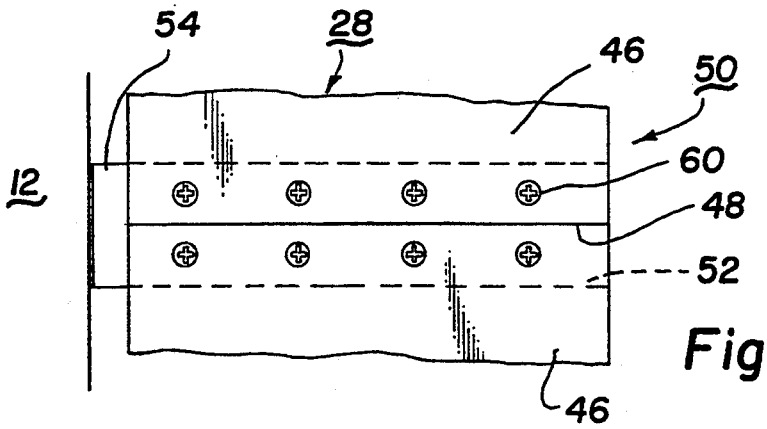
FIG. 7 is a plan view as seen substantially from the position 7—7 of FIG. 6.

Doubler 50, as can be best understood with reference to FIGS. 6 and 7, underlies and spans the contiguous ends of tandem segments 46 by means of a lateral underlying plate 52. Hinge 54 pivotally connects plate 52 to flange 56 side mounted onto the lane bed via screws 58. In turn, a plurality of countersunk screws 60 secure the tandem segments 46 to the underlying doubler plate 52. It can be understood with regard thereto that the segments 46 of section 28 are arcuately displaceable as a unit about the hinges 44 and 54 from the position shown solid in FIG. 3 to the raised more upright relation above the plane of bed 12 shown in phantom.

For effecting displacement of section 28, the underside of each individual segment 46 includes at least one centrally located or a plurality of uniformly spaced brackets 62 secured to the underside of the segment. Protruding from each bracket is a clevis 64 providing a connection for the displaceable piston 65 of a stationary actuator unit 66. The actuator unit can suitably be an electrical bell crank or pneumatic piston selected for the installation and suitable for concomitant displacement of entire section 28 as a unit. Generally underlying section 28 for aesthetically concealing the open space beneath section 28 when elevated, is a canted plate 68 of polymer plastic or the like.

Figure 4:
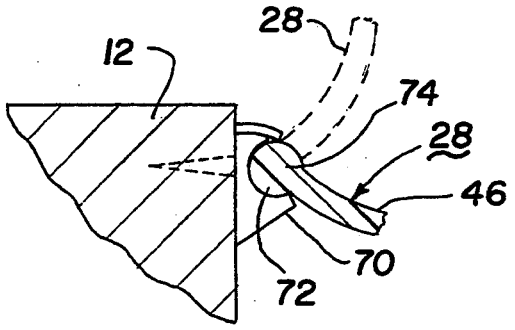
FIGS. 4 and 5 are optional hinge constructions for use with the embodiment of FIG. 3.
Figure 5:
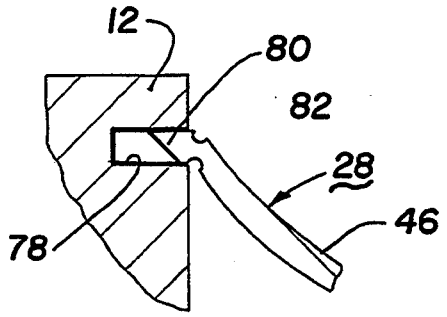

Optional hinging structures for section 28 are illustrated in FIGS. 4 and 5. As shown in FIG. 4, there is provided a hinge receptacle 70 that is attached to the side face of lane bed 12. The receptacle includes a semicircular socket recess 72 in which to receive bulbous outside edge 74 formed longitudinally continous on the individual segments 46. Installation is effected by sliding edge 74 into socket 72 from end to end.

For the embodiment of FIG. 5, a longitudinal recess 78 is provided extending laterally inward from the side face of bed 12 and adapted to secure a flange 80 fitted therein. A modified living hinge 82 enables vertically arcuate displacement of section 28.

Figure 3:
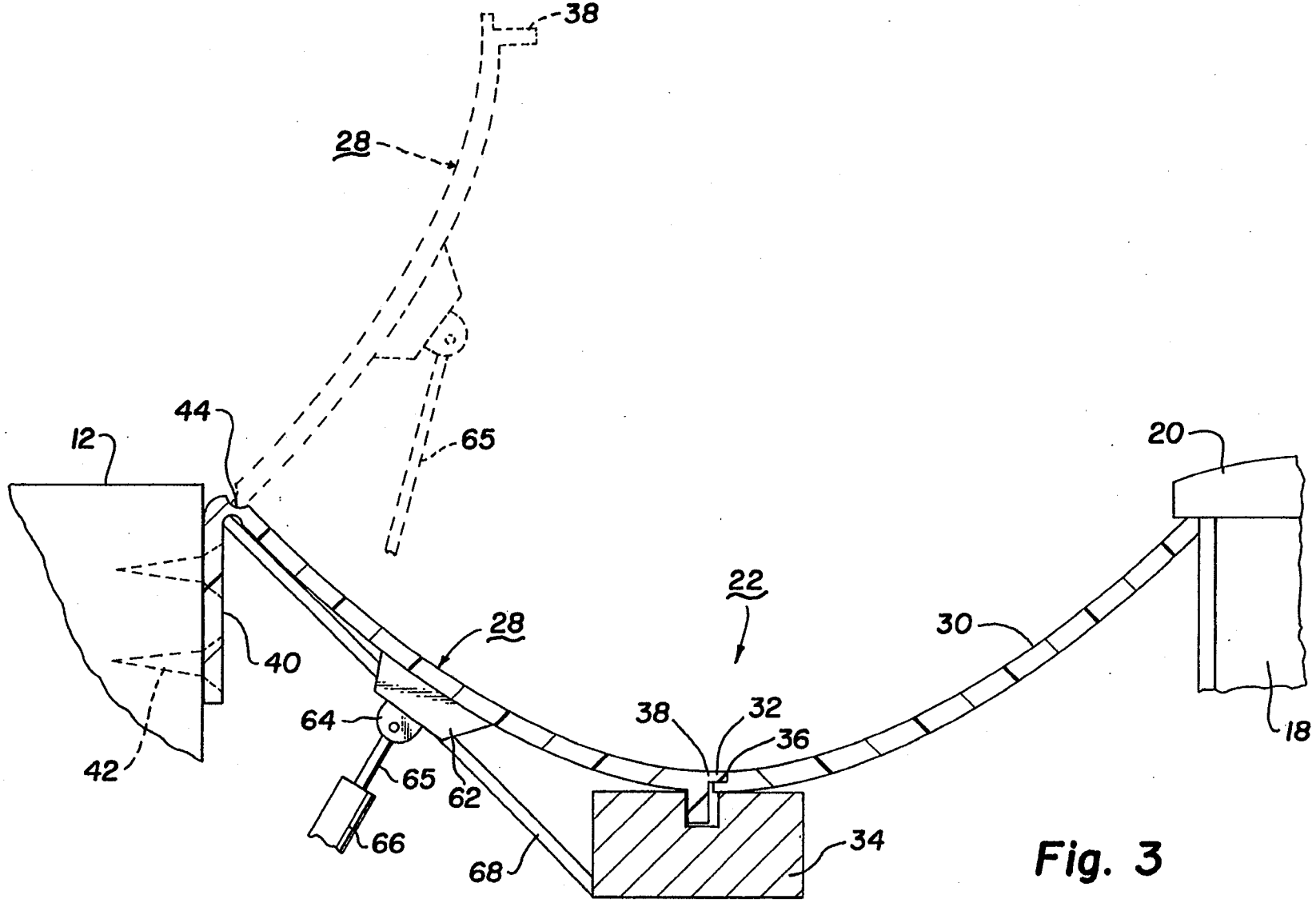
FIG. 3 is an enlarged sectional view of an embodiment of the invention.

In operation for conventional bowling, the two sections 28 and 30 are positioned interfitting together along a seam 32 overlying support block 34. In this relation,- the structure cooperates to substantially conform to a standard gutter cross-section in which to receive and dispose of a mis-directed ball delivered on the lane bed. Where bumper bowling is desired, the section 28 via the individual actuators 66 is caused to be arcuately displaced upwardly to above the plane of lane bed 12 (FIGS. 2 and 3). This will cause any ball 11 that would otherwise have entered the gutter to be deflected and bumped back onto the lane bed until passing through the pin area at the distal end of the bed. Being that only a transverse section of the gutter formation is caused to be displaced, the operating mechanism and supporting structure therefore is relatively simple for causing the section to be displaced upwardly to the bumper position shown in phantom. As a consequence, the cost of fabrication is relatively modest while enabling the operating mechanism to be easily serviced.

By the above description there is disclosed a novel construction for an improved bowling alley bumper system that can be selectively utilized for either conventional or bumper bowling. It is evident that by virtue of the simplicity associated with the construction, assembly and installation of the components is neither material nor labor intensive. Moreover, whereas the preferred embodiment hereof has been described principally for use with a conventional bowling ball in mind ($8\frac{5}{8}$ inch. diam.) it could likewise be readily utilized with a "duck pin" or "candle pin" bowling ball ($4\frac{1}{2}$ inch. diam.) without the need for modification.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. In a bumper system for selectively guarding a gutter along a lane bed of a bowling alley that extends from an entrance location at which a ball is delivered to a discharge exit location an the distal end of the lane bed, said bumper system comprising:

elongated longitudinal gutter of cross-sectionally concave shape transversely divided into at least two individual elongated concave sections having outer edges including first means to longitudinally secure said sections to an adjacent alley structure and inner edges having second means to effect a mutual interfit between individually adjacent sections for defining a gutter cross-section;

third means provided between at least one of said gutter sections and the adjacent bed for affording pivotal displacement about said first means; and actuator apparatus secured to an underside of said pivotal gutter section and operable between a first position in which the inner edge of said pivotal section cooperates with said second means to define a gutter for conventional bowling and a second position in which said pivotal gutter section is arcuately raised away from the other concave section to above the lane bed for preventing a misdirected ball from entering said gutter from said lane bed.

2. A bumper system in accordance with claim 1 in which said gutter is comprised of two juxtaposed transversely divided sections, one section of which is pivotal and the other section of which is stationary.

3. A bumper system in accordance with claim 2 in which the second means of the mutually inner edges of said juxtaposed sections when in said first position effect a contiguous interfit with respect to each other to cooperate in defining a continuous gutter of concave cross-section.

4. A bumper system in accordance with claim 3 in which there is included a longitudinal support underlying the inner edges of said sections when said pivotal section is in said first position.

5. A bumper system in accordance with claim 1 in which at least the pivotal of said sections is comprised of a plurality of elongaged tandem segments joined end-to-end and each of said segments is acted upon by actuator apparatus secured to its underside.

6. A bumper system in accordance with claim 5 in which each of said segments is connected to actuator apparatus comprising a plurality of individual actuator units longitudinally spaced along the underside of the respective segments.

7. A bumper system in accordance with claim 6 in which said tandem segments are joined at contiguous ends by a doubler underlying said contiguous ends.

8. A bumper system in accordance with claim 1 which said third means comprises a hinge.

9. A bumper system in accordance with claim 8 in which said hinge comprises a living hinge.

10. A bumper system in accordance with claim 8 in which said hinge comprises an elongated interfitting formation of bulb and socket.

* * * * *